US008797128B2

(12) United States Patent
Liljestrand et al.

(10) Patent No.: US 8,797,128 B2
(45) Date of Patent: Aug. 5, 2014

(54) SWITCH HAVING TWO SETS OF CONTACT ELEMENTS AND TWO DRIVES

(75) Inventors: Lars Liljestrand, Västerås (SE); Lars E. Jonsson, Västerås (SE); Per Skarby, Würenlos (CH); Ryan Chladny, Muskego, WI (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/444,625

(22) Filed: Apr. 11, 2012

(65) Prior Publication Data

US 2012/0256711 A1 Oct. 11, 2012

(30) Foreign Application Priority Data

Apr. 11, 2011 (EP) ..... 11161924

(51) Int. Cl.

| | |
|---|---|
| ***H01H 67/02*** | (2006.01) |
| ***H01H 63/02*** | (2006.01) |
| ***H01H 33/00*** | (2006.01) |
| ***H01H 1/22*** | (2006.01) |
| ***H01H 50/32*** | (2006.01) |

(52) U.S. Cl.

CPC ..... *H01H 1/226* (2013.01); *H01H 50/323* (2013.01)

USPC ..... 335/107; 335/106; 335/121; 335/126; 335/127; 335/133; 335/134; 200/239; 218/92; 218/107; 218/110; 218/146

(58) Field of Classification Search

CPC ..... H01H 1/226; H01H 50/323

USPC ..... 335/71–72, 75, 87–89, 91–92, 97, 335/106–107, 121, 126, 127, 133–134, 136, 335/184, 185, 192, 195, 201, 202; 200/1 R, 200/275, 239, 241, 272, 274; 218/91, 92, 218/96, 107, 110, 146

See application file for complete search history.

(56) References Cited

U.S. PATENT DOCUMENTS 1,918,732 A * 7/1933 Adams ..... 335/136
2,894,095 A 7/1959 Wijkman (Continued)

FOREIGN PATENT DOCUMENTS

FR 2 662 300 A1 11/1991
WO WO 2010/037424 A1 4/2010
WO WO 2010/142346 12/2010

OTHER PUBLICATIONS

European Search Report for EP 11161924 dated Sep. 9, 2011.

(Continued)

*Primary Examiner* — Mohamad Musleh

(74) *Attorney, Agent, or Firm* — Buchanan Ingersoll Rooney PC

(57) ABSTRACT

An exemplary medium or high voltage switch has a first set of contact elements and a second set of contact elements. Each contact element includes an insulating carrier carrying conducting elements. In the closed current-carrying state of the switch, the conducting elements align to form one or more current paths between terminals of the switch along an axial direction. For opening the switch, the contact elements are mutually displaced by through two drives along a direction perpendicular to the axial direction. The switching arrangement is arranged in a fluid-tight housing in a gas of elevated pressure or in a liquid. The switch has a high voltage withstand capability and fast switching times.

22 Claims, 3 Drawing Sheets

(56) References Cited

U.S. PATENT DOCUMENTS

| | | | | |
|---|---|---|---|---|
| 3,246,101 | A * | 4/1966 | Caputo | 335/115 |
| 3,310,640 | A | 3/1967 | Bleibtreau | |
| 3,378,796 | A * | 4/1968 | Caputo | 335/72 |
| 3,430,062 | A * | 2/1969 | Roth | 361/9 |
| 4,105,879 | A * | 8/1978 | Tsukushi et al. | 218/59 |
| 4,529,953 | A * | 7/1985 | Myers | 335/126 |
| 7,235,751 | B2 | 6/2007 | Liljestrand et al. | |
| 2004/0245857 | A1 | 12/2004 | Liljestrand et al. | |
| 2013/0015930 | A1 * | 1/2013 | Jonsson | 335/192 |

OTHER PUBLICATIONS

European Search Report for EP 11161921 dated Sep. 16, 2011.

* cited by examiner

SWITCH HAVING TWO SETS OF CONTACT ELEMENTS AND TWO DRIVES

RELATED APPLICATION

This application claims priority under 35 U.S.C. §119 to European Application No. 11161924.3 filed in Europe on Apr. 11, 2011, the content of which is hereby incorporated by reference in its entirety.

FIELD

The present disclosure relates to a switch, such as a high or medium voltage switch a first and a second set of contact elements that are mutually displaceable. The disclosure also relates to a current breaker comprising such a switch.

BACKGROUND

The present disclosure relates to a switch having a first and a second set of contact elements and a drive adapted to displace one of the contact elements along a displacement direction. Each contact element carries at least one conducting element. In a first mutual position of the contact elements, their conducting elements combine to form at least one conducting path between the first and second terminals of the switch, in a direction transversally to the displacement direction. In a second position of the contact elements, the conducting elements are mutually displaced into staggered positions and therefore the above conducting path is interrupted.

SUMMARY

An exemplary high or medium voltage switch is disclosed comprising: a first and a second terminal; a first and a second set of contact elements arranged between the first and the second terminal; and a first drive connected to said first set of contact elements adapted to mutually displace the sets of contact elements along a displacement direction, wherein each contact element includes an insulating carrier carrying at least one conducting element, wherein in a first mutual position of said contact elements the at least one conducting element of each contact element forms at least one conducting path in an axial direction between said first and said second terminals in a direction transversally to said displacement direction, wherein in a second mutual position of said contact elements the at least one conducting element of each contact element is mutually displaced and do not form said conducting path, wherein the switch includes a second drive connected to said second set of contact elements, and wherein said first and second drives are adapted to simultaneously move said first and second set, respectively, in opposite directions.

An exemplary current breaker is disclosed comprising: a switch including a first and a second terminal, a first and a second set of contact elements arranged between the first and the second terminal; and a first drive connected to said first set of contact elements adapted to mutually displace the sets of contact elements along a displacement direction, wherein each contact element includes an insulating carrier carrying at least one conducting element, wherein in a first mutual position of said contact elements the at least one conducting element of each contact element forms at least one conducting path in an axial direction between said first and said second terminals in a direction transversally to said displacement direction, and wherein in a second mutual position of said contact elements the conducting elements are mutually displaced and do not form said conducting path, and wherein the switch includes a second drive connected to said second set of contact elements, wherein said first and second drives are adapted to simultaneously move said first and second set, respectively, in opposite directions said current breaker comprising: a primary electrical branch and a secondary electrical branch in parallel; at least one solid state breaker arranged in the primary electrical branch; and a plurality of solid state breakers arranged in series in the secondary electrical branch, wherein a number of solid state breakers in the secondary electrical branch is larger than a number of solid state breakers in the primary electrical branch, and wherein said switch is arranged in said primary electrical branch in series to said solid state breaker of said primary electrical branch.

BRIEF DESCRIPTION OF THE DRAWINGS

The disclosure will be better understood and embodiments and advantages other than those set forth above will become apparent from the following detailed description thereof. Such description makes reference to the annexed drawings, wherein.

DETAILED DESCRIPTION

Figure 1:
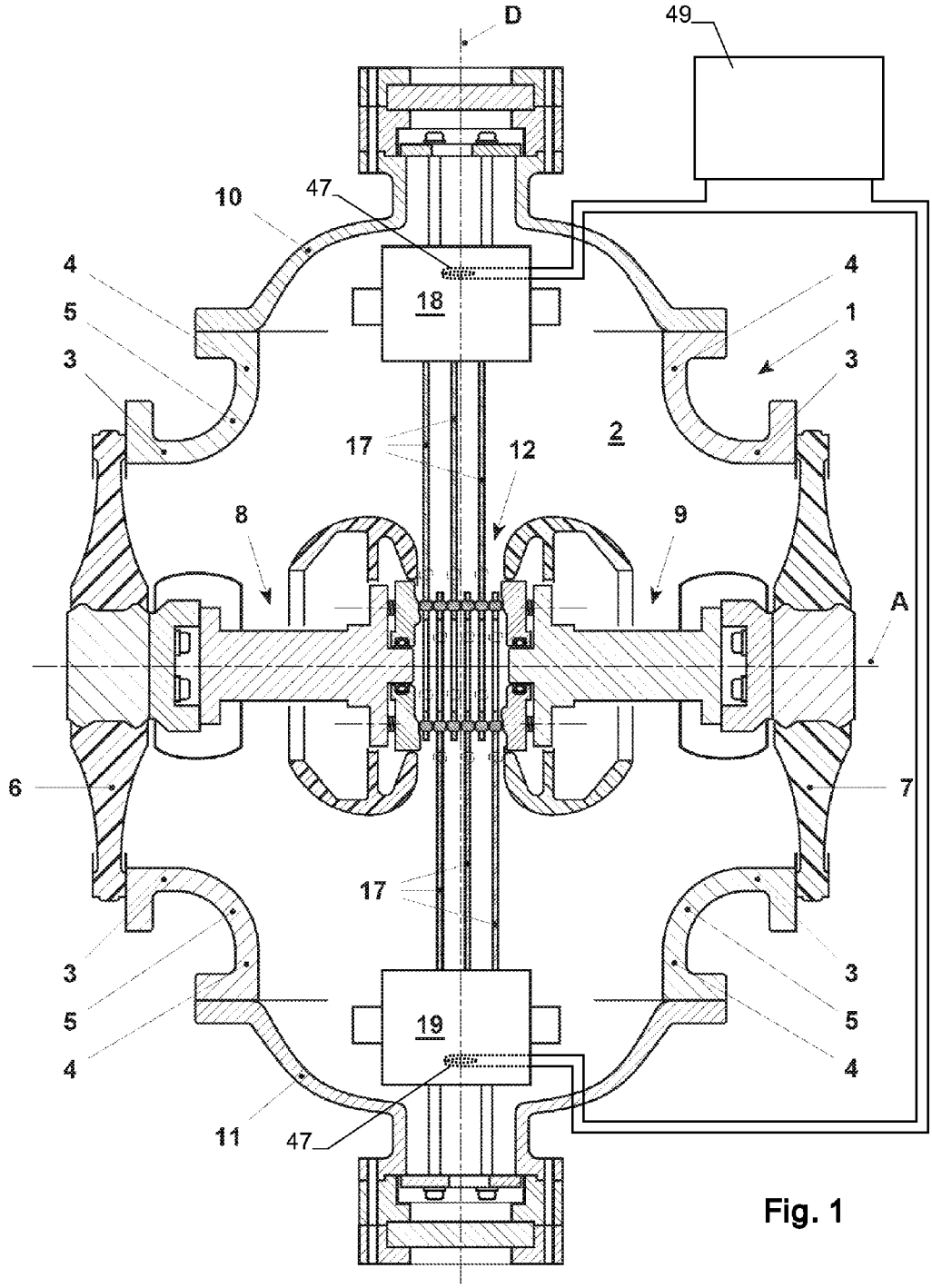
FIG. 1 shows a cross-sectional view of a switch in accordance with an exemplary embodiment.

Exemplary embodiments of the present disclosure are directed to a switch having a first and a second terminal for applying the current to be switched. Further, the switch has a first and a second set of contact elements and a drive adapted to mutually displace the contact elements relative to each other along a displacement direction. Each contact element includes an insulating carrier that carries at least one conducting element. The positions of the conducting elements are such that:

(1) in a first mutual position of the contact elements the conducting elements form one or more conducting paths along an axial direction between the first and the second terminals, i.e. the switch is in the closed, conducting position; and (2) in a second mutual position of the contact elements the conducting elements are mutually displaced such that the conducting path does not form, i.e. the switch is in its opened, non-conducting position.

The switch includes a first and a second drive, with each drive being connected to one of said sets of contact elements. The first and a second drives are adapted to simultaneously, i.e. concurrently or during the same time window, move the first and second set, respectively, in opposite directions. By this measure, the relative contact separation speed as well as the total contact separation distance are basically doubled, which allows faster switching and reduces the travel length of each drive resulting in a fast buildup of dielectric strength across the contact gap.

Each drive can include an electrical drive coil and a movable member, wherein the movable member can be moved between a first and a second location and is connected to the first or second set of contact elements, respectively. The first location corresponds to the first mutual position of the contact elements and the second location corresponds to the second mutual position of the contact elements, or vice versa. Each drive is adapted to accelerate the movable member from the first position to the second position, in a direction away from the drive coil, when a current flows through the drive coil. Thus, current pulses through the drive coils can be used to close or open the switch.

Hence, in yet a further advantageous embodiment, the switch includes a current pulse generator structured to generate concurrent current pulses in the drive coil of the first drive and the drive coil of the second drive, thereby achieving a concurrent actuation of both drives.

A very simple design to ensure a concurrent motion is achieved by arranging the drive coil of the first drive electrically in series to the drive coil of the second drive. Thus, any current pulse simultaneously acts on both drives.

The drives can be arranged within the housing, thus obviating the need for mechanical bushings.

The switch can be used in high voltage applications (i.e. for voltages above 72 kV, for example), but it can also be used for medium voltage applications (e.g., between some kV and 72 kV).

Other exemplary embodiments are listed in the dependent claims, combinations of dependent claims as well as in the description below together with the figures.

FIG. 1 shows a cross-sectional view of a switch in accordance with an exemplary embodiment. The switch of FIG. 1 includes a fluid-tight housing 1 enclosing a space 2 filled with an insulating fluid, in particular SF6 or air or other at elevated pressure, or an oil.

Housing 1 forms a GIS-type metallic enclosure of manifold type and includes two tube sections. A first tube section 3 extends along an axial direction A, and a second tube section 4 extends along a direction D, which is called the displacement direction for reasons that will become apparent below. Axial direction A can be perpendicular or nearly perpendicular to displacement direction D. The tube sections are formed by a substantially cross-shaped housing section 5.

Housing 1 can be at ground potential (e.g. in a GIS=gas-insulated substation), but it may also be on high voltage potential (e.g. in a life tank breaker).

First tube section 3 ends in first and second support insulators 6 and 7, respectively. First support insulator 6 carries a first terminal 8 and second support insulator 7 carries a second terminal 9 of the switch. The two terminals 8, 9 extending through the support insulators 6, 7 carry the current through the switch, substantially along axial direction A.

Second tube section 4 ends in a first and a second cap or flange portion 10 and 11, respectively.

First terminal 8 and second terminal 9 extend towards a center of space 2 and end at a distance from each other, with a switching arrangement 12 located between them, at the intersection region of first tube section 3 with second tube section 4.

Figure 2:
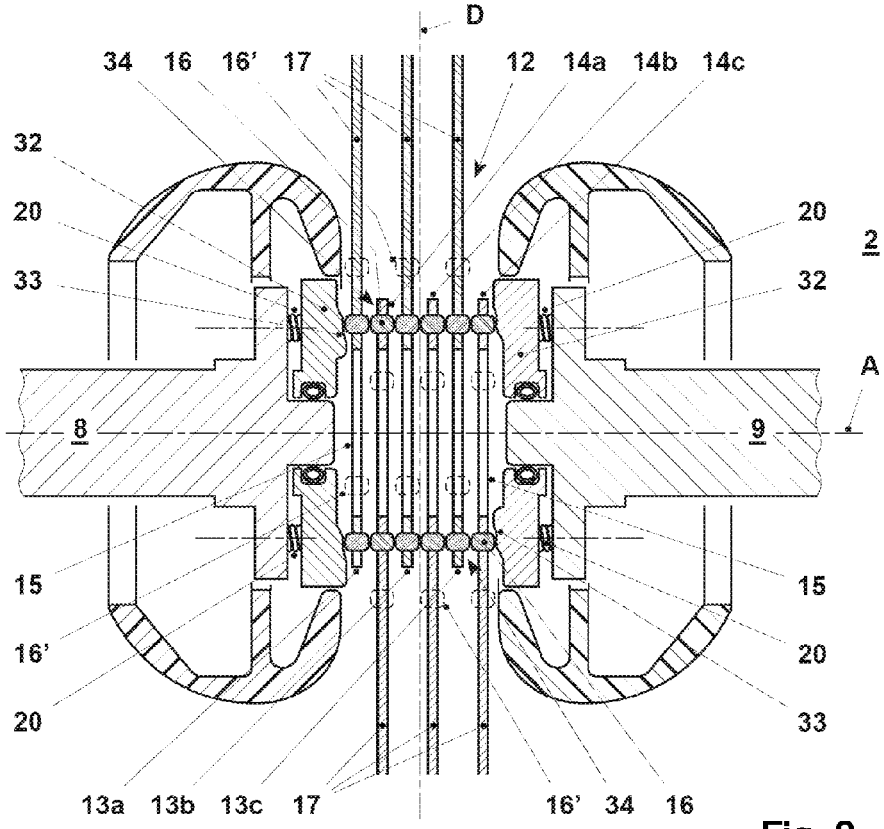
FIG. 2 shows the an enlarged cross-sectional view of a contact elements in accordance with an exemplary embodiment.

FIG. 2 shows an enlarged cross-sectional view of a contact element in accordance with an exemplary embodiment. As shown in FIG. 2, switching arrangement 12 includes a first set of contact elements 13*a*, 13*b*, 13*c* and a second set of contact elements 14*a*, 14*b*, 14*c*. In the embodiment shown here, each set includes three contact elements, but that number may vary, and, for example, be two or more than three. The first and second set may also have different numbers of contact elements, e.g. two and three, respectively. Advantageously, the number is at least two contact elements per set. The contact elements of the two sets are stacked alternatingly, i.e. each contact element of one set is adjacent to two contact elements of the other set unless it is located at the end of switching arrangement 12, in which case it is located between one contact element of the other set and one of the terminals 8, 9.

Figure 3:
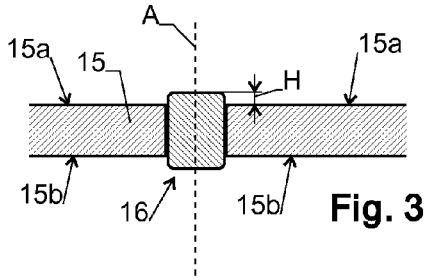
FIG. 3 shows a sectional view of a first carrier with a conducting element in accordance with an exemplary embodiment.

FIG. 3 shows a sectional view of a first carrier with a conducting element in accordance with an exemplary embodiment. As shown in FIGS. 2 and 3, each contact element includes a plate-shaped insulating carrier 15, one or more conducting elements 16 and an actuator rod 17. In the exemplary embodiment as shown, each carrier 15 carries two conducting elements 16. In the above examples, each insulating carrier 15 had its own actuator rod 17. Alternatively, the number of actuator rods may be different, in particular smaller than the number of insulating carriers 15, with at least some of the insulating carriers being mechanically interconnected.

FIGS. 1 and 2 show the switch in the closed state with the contact elements 13*a*, 13*b*, 13*c*, 14*a*, 14*b*, 14*c* in a first mutual position, where the conducting elements 16 align to form two conducting paths 34 along axial direction A between the first and the second terminals 8, 9. The conducting paths 34 carry the current between the terminals 8, 9. Their number can be greater than one in order to increase continuous current carrying capability. In another exemplary embodiment, an arrangement with three contact elements 16 in each insulating carrier 15 is possible, which lead to three conducting paths 34 when the switch is closed. In a further exemplary embodiment a non-inline arrangement with four contact elements 16 in each insulating carrier 15 is also possible, which leads to four conducting paths 34 when the switch is closed.

The contact elements 13*a*, 13*b*, 13*c*, 14*a*, 14*b*, 14*c* can be moved along the displacement direction D into a second position, where the conducting elements 16 are staggered in respect to each other and do not form a conducting path. In FIG. 2, the position of the conducting elements in this second position is shown in dotted lines under reference number 16'. As can be seen, the conducting elements 16' are now separated from each other along direction D, thereby creating several contact gaps (two times the number of contact elements 13, 14), thereby quickly providing a high dielectric withstand level.

To achieve such a displacement, and as best can be seen in FIG. 1, the actuator rods 17 are connected to two drives 18, 19. A first drive 18 is connected to the actuator rods 17 of the first set of contact elements 13*a*, 13*b*, 13*c*, and a second drive 19 is connected to the actuator rods 17 of the second set of contact elements 14*a*, 14*b*, 14*c*.

In the exemplary embodiments shown in FIGS. 1 and 2, the switch is opened by pulling the actuator rods 17 away from the center of the switch, thereby bringing the conducting elements into their second, staggered position. Alternatively, the rods 17 can be pushed towards the center of the switch, which also allows to bring the conducting elements into a staggered position.

The drives 18, 19 can e.g. operate on the repulsive Lorentz-force principle and be of the type shown in U.S. Pat. No. 7,235,751, which is herewith incorporated by reference in its entirety. Each drive is able to displace one set of contact elements along the displacement direction D. They are adapted and controlled to move the first and second sets in opposite directions at the same time in order to increase the travelling length and speed of displacement. An exemplary embodiment of a suitable drive is described in more detail below.

The drives 18, 19 are arranged in opposite end regions of second tube section 4.

Figure 6:
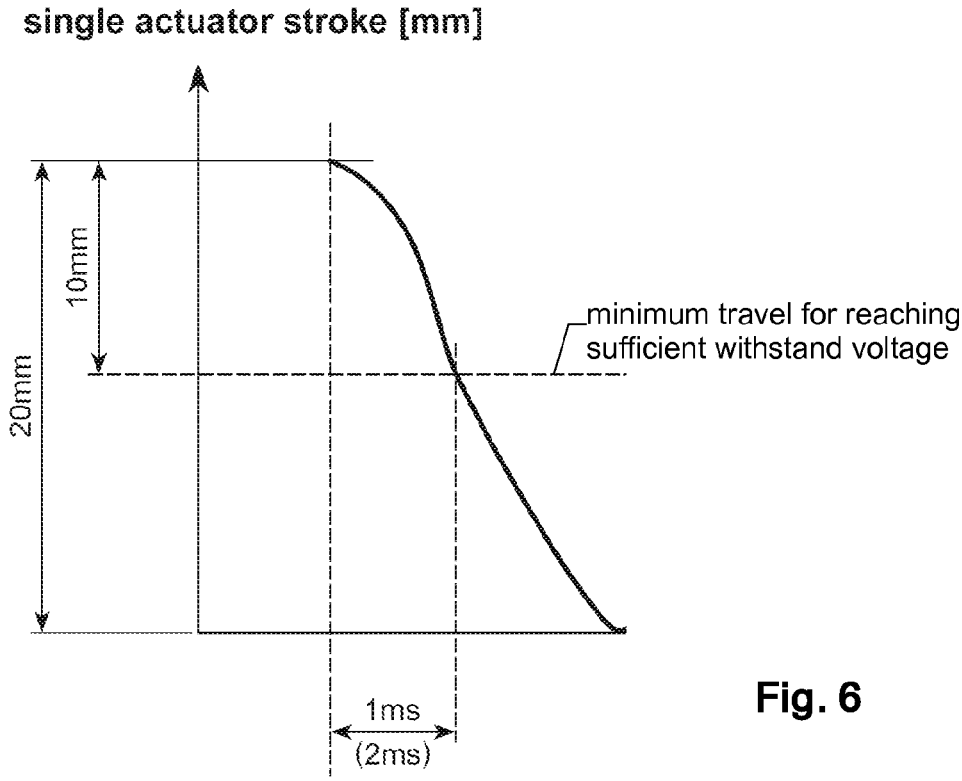
FIG. 6 illustrates a stroke vs. time curve when opening and closing the switch in accordance with an exemplary embodiment.

The full stroke (e.g. 20 mm per drive) of the drives may not be necessary to travel in order for the contact system to provide the specified dielectric strength, but a distance much shorter (e.g. 10 mm per drive) may suffice, which can be reached in an even shorter time. This arrangement can also provides certain safety in case of back-travel upon reaching the end-of-stroke position and damping phase of the actuators. FIG. 6 illustrates a stroke vs. time curve when opening and closing the switch in accordance with an exemplary embodiment. As shown in FIG. 6, a sufficient separation of the conducting elements 16 can be reached within 1 or 2 ms.

As shown in FIG. 2, each terminal 8, 9 carries a contact plate 32 forming a contact surface 33 contacting the conducting elements 16 when the switch is in its first position. The contact plates 32 are mounted to the terminals 8, 9 in axially displaceable manner, with springs 20 elastically urging the contact surface 33 against the conducting elements, thereby compressing the conducting elements 16 in their aligned state for better conduction. In the embodiment illustrated in FIG. 2, helical compression springs 20 are used for this purpose, but other types of spring members can be used as desired. Also, even though it is advantageous if there is at least one spring member in each terminal 8, 9, a compression force for the aligned conducting elements 16 can also be generated by means of a spring member(s) in only one of the terminals 8, 9.

FIG. 3 shows a sectional view of an exemplary embodiment of single conducting element 16 in its carrier 15. As shown in FIG. 3, the conducting element 16 axially projects by a height H over both axial surfaces 15*a*, 15*b* of carrier 15. In other words, the axial extension (i.e. the extension along axial direction A) of conducting element 16 exceeds the axial extension of carrier 15 that surrounds it. The axial extension of carrier 15 at the location of conducting element 16 can be at least, for example, 10% less than the axial extension of conducting element 16.

Conducting element 16 can include an aluminium body with silver coating.

In the exemplary embodiment of FIG. 3, conducting element 16 is fixedly connected to carrier 15, e.g. by means of a glue.

Figure 4:
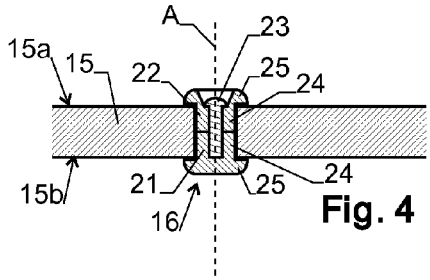
FIG. 4 shows a second carrier and a conducting element in accordance with an exemplary embodiment.

FIG. 4 shows a second carrier and a conducting element in accordance with an exemplary embodiment. As shown in FIG. 4, contact element 16 includes a first section 21 and a second section 22 connected to each other, e.g. by means of a screw 23. Each section 21, 22 includes a shaft 24 and a head 25, with the head 25 having larger diameter than the shaft 24. The two shafts 24 extend axially through an opening 26 of carrier 15 and the heads rest against the surfaces 15*a*, 15*b* of carrier 15. The distance between the two heads 25 is slightly larger than the axial extension of carrier 15, such that conducting element 16 is movable in axial direction A in respect to carrier 15 for the reasons described above.

In the exemplary embodiment of FIG. 4, a screw was used for connecting the two sections 21, 22. Alternatively, a rivet can be used as well. In yet a further alternative, one of the sections 21, 22 can be designed as a male section having a pin introduced into an opening of the other, female section for forming a press-fit or shrivel-fit connector.

Figure 5:
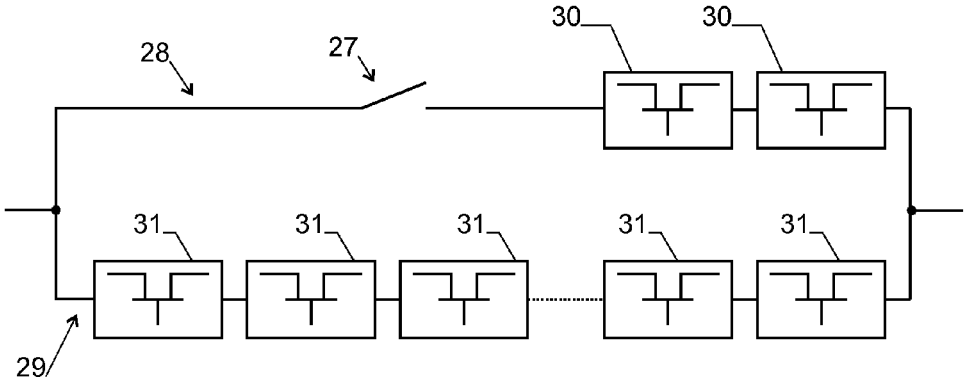
FIG. 5 shows an application of the switch in accordance with an exemplary embodiment.

FIG. 5 shows an application of the switch in accordance with an exemplary embodiment. FIG. 5 shows an application of the exemplary switch 27 of the present disclosure in a high voltage circuit breaker. This circuit breaker includes a primary electrical branch 28 and a secondary electrical branch 29 arranged parallel to each other. At least one solid state breaker 30 is arranged in primary branch 28 and a plurality of solid state breakers 31 is arranged in series in secondary branch 29. The number of solid state breakers 31 in the secondary branch 29 is much larger than the number of solid state breakers 30 in the primary branch 28.

When the circuit breaker is in its closed current-conducting state, all solid state breakers are conducting and switch 27 is closed current-conducting state. The current substantially bypasses secondary branch 29, because the voltage drop in primary branch 28 is much smaller. Hence, for nominal currents, the losses in the circuit breaker are comparatively small.

When the current is to be interrupted, in a first step the solid state breaker(s) 30 in primary branch 28 are opened, which causes the current in primary branch 28 to drop to a small residual value that is then interrupted by opening switch 27. Now, the whole current has been commuted to secondary branch 29. In a next step, the solid state breakers 31 in secondary branch 29 are opened.

Hence, in the opened state of the circuit breaker of FIG. 5, switch 27 carries the whole voltage drop in the secondary branch, thereby protecting the solid state breaker(s) 30 of primary branch 28 from dielectric breakdown.

The switch described above is well suited for such an application as switch 27 because of its fast switching time and its large dielectric strength.

Figure 7:
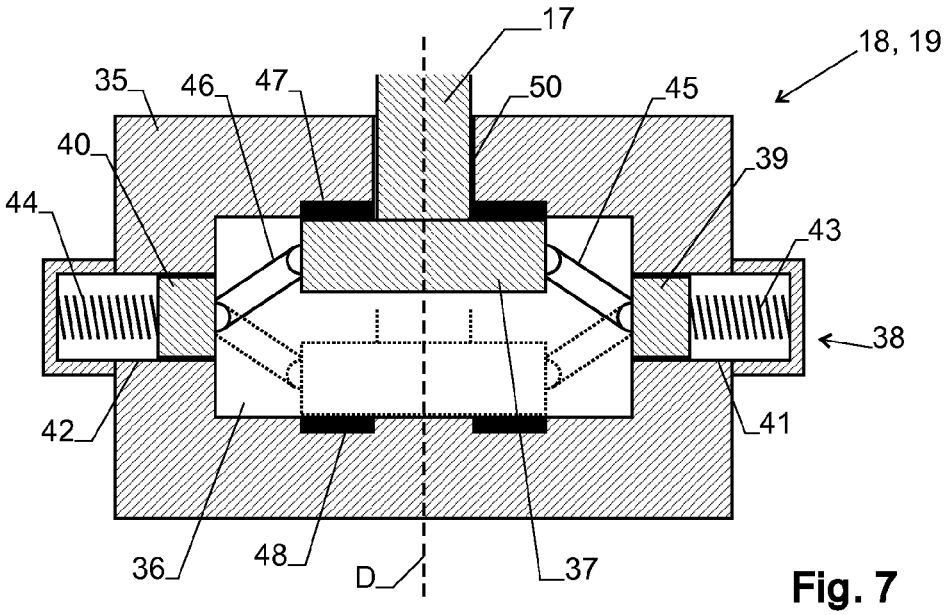
FIG. 7 shows a sectional view of a drive in accordance with an exemplary embodiment.

FIG. 7 shows a sectional view of a drive in accordance with an exemplary embodiment. As shown in FIG. 7, drive 18, 19 includes a frame 35 enclosing a chamber 36. A movable member 37 is arranged within chamber 36 and held by a bistable suspension 38. Movable member 37 is connected to the actuator rods 17 of one set of contact element 13*a*, 13*b*, 13*c* or 14*a*, 14*b*, 14*c*, with the actuator rods 17 extending through an opening 50 in frame 35.

Bistable suspension 38 includes first and second pistons 39, 40 movable along bores 41, 42 in a direction perpendicular to displacement direction D. The pistons are pushed towards chamber 36 by means of first and second springs 43, 44. Each piston 39, 40 is connected to movable member 37 by means of a link 45, 46. Each link 45, 46 is formed by a substantially rigid rod, which is, at a first end, rotatably connected to its piston 39, 40, and, at a second end, rotatably connected to movable member 37.

The springs 43, 44 urge the links 45, 46 against movable member 37. Thus, movable member 37 can assume two stable locations within bistable suspension 38, namely a first location as shown with solid lines in FIG. 7, as well as a second location as shown in dashed lines. The first location corresponds to the first mutual position of the contact elements, and the second location to the second mutual position.

To operate movable member 37, first and second drive coils 47, 48 are arranged at opposite sides of chamber 36. Further, movable member 37 is of a conducting material, at least on its surfaces facing the drive coils 47, 48. In the first and second stable locations, movable member 37 is adjacent to first and second drive coil 47, 48, respectively.

Hence, when movable member 37 is e.g. in its first location and a current pulse is sent through first drive coil 47, a mirror current is generated within movable member 37, which leads to a repulsive force that accelerates movable member 37 away from first coil 47. The kinetic energy imparted on movable member 37 in this manner is sufficient to move movable member 37 to its second location adjacent to second drive coil 48.

The two drives 18, 19 should be operated synchronously, or at least in the same time window. A pulse generator 49 (e.g, see FIG. 1) is provided for this purpose. Pulse generator 49 is adapted to generate concurrent current pulses to the first drive coils 47 of both drives 18 and 19 for opening the switch, and/or concurrent current pulses to the second coils 48 of both drives 18 and 19 for closing the switch.

In an exemplary embodiment, a concurrent operation can for example be achieved by electrically arranging the first drive coils 47 of both switches in series, as shown by the feed lines between the drives 18, 19 and pulse generator 49 in FIG. 1. Similarly, the second drive coils 48 of both switches should advantageously be arranged in series as well.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1: housing
2: space
3, 4: tube sections
5: housing section
6, 7: support insulators
8, 9: terminals
10, 11: caps, flanges
12: switching arrangement
13*a*, 13*b*, 13*c*: first set of contact elements
14*a*, 14*b*, 14*c*: second set of contact elements
15: insulating carrier
15*a*, 15*b*: axial surfaces of insulating carrier
16, 16': conducting elements
17: actuator rods
18: contact plate
19: contact surface
20: springs
21, 22: first and second sections of contact element
23: screw
24, 25: shaft and head
26: opening
27: switch
28, 29: primary and secondary branch
30, 31: semiconductor breakers
32: contact plate
33: contact surface
34: conducting path
35: frame
36: chamber
37: movable member
38: bistable suspension
39, 40: pistons
41, 42: bores
43, 44: springs
45, 46: links
47, 48: drive coils
49: pulse generator
50: opening

What is claimed is:

1. A fast-switching high or medium voltage switch comprising:

a first and a second terminal;

a first and a second set of plural contact elements arranged between the first and the second terminal, each contact element of the first and second set including an insulating carrier having at least one conducting element; and a first drive connected to said first set of contact elements configured to mutually displace each contact element of the first set along a displacement direction between a first mutual position and a second mutual position, wherein in the first mutual the at least one conducting element of each contact element of the first set forms a conducting path with the at least one conducting element of an adjacent contact element of the second set, the conducting path being formed in a first axial direction between said first and said second terminals, where said first axial direction is transversal to said displacement direction, wherein in the second mutual position the at least one conducting element of each contact element of the first and second sets are mutually displaced from one another and do not form said conducting path, wherein the switch includes a second drive connected to said second set of contact elements, and wherein said first and second drives are configured to simultaneously move said first and second set, respectively, in opposite directions.

2. The switch of claim 1, wherein each of said drives includes an electrical drive coil and a movable member, wherein said movable member is movable between a first and a second location and is connected to said first or second set of contact elements, respectively, wherein each drive is adapted to accelerate said movable member from said first location away from said drive coil into said second location when a current flows through said drive coil.

3. The switch of claim 2, further comprising a current pulse generator configured to generate concurrent current pulses to the drive coil of said first drive and to the drive coil of said second drive.

4. The switch of claim 2, wherein the drive coil of said first drive and the drive coil of said second drive are electrically arranged in series.

5. The switch of claim 2, wherein each movable member is arranged in a bistable suspension, with said first and second location forming stable states of said bistable suspension.

6. The switch of claim 5, wherein each drive includes a first drive coil for moving said movable member from said first to said second location and a second drive coil for moving said movable member from said second to said first location.

7. The switch of claim 3, wherein the drive coil of said first drive and the drive coil of said second drive are electrically arranged in series.

8. The switch of claim 3, wherein each movable member is arranged in a bistable suspension, with said first and second location forming stable states of said bistable suspension.

9. The switch of claim 8, wherein each drive includes a first drive coil for moving said movable member from said first to said second location and a second drive coil for moving said movable member from said second to said first location.

10. The switch of claim 1, wherein the switch includes a housing.

11. The switch of claim 10, wherein said housing comprises:

a first tube section ending in a first and a second support insulator at opposite sides with the first terminal extending through the first support insulator and the second terminal extending through the second support insulator; and a second tube section, arranged substantially perpendicular to said first tube section, wherein said first and second drives are arranged in opposite end regions of said second tube section;

wherein said contact elements are arranged at an intersection region of said first and second tube sections.

12. The switch of claim 11, wherein the housing is such that said first and second contact elements are encapsulated in a fluid-tight housing and wherein said fluid-tight housing contains an electrically insulating fluid surrounding said contact elements.

13. The switch of claim 11, wherein said drives are arranged within the housing.

14. A current breaker comprising:

a switch including a first and a second terminal, a first and a second set of contact elements arranged between the first and the second terminal, and a first drive connected to said first set of plural contact elements adapted to mutually displace the sets of contact elements each contact element of the first set along a displacement direction between a first mutual position and a second mutual position, wherein each contact element of the first and second sets includes an insulating carrier carrying at least one conducting element, wherein in a the first mutual position of said contact elements the at least one conducting element of each contact element of the first set forms at least one conducting path with the at least one conducting element of at least one adjacent contact element of the second set, the conducting path being formed in an axial direction between said first and said second terminals in a direction transversally to said displacement direction, wherein in a the second mutual position of said contact elements the at least one conducting elements of the first and second sets are mutually displaced and do not form said conducting path, wherein the switch includes a second drive connected to said second set of contact elements, and wherein said first and second drives are configured to simultaneously move said first and second set, respectively, in opposite directions;

a primary electrical branch and a secondary electrical branch in parallel;

at least one solid state breaker arranged in the primary electrical branch; and a plurality of solid state breakers arranged in series in the secondary electrical branch, wherein a number of solid state breakers in the secondary electrical branch is larger than a number of solid state breakers in the primary electrical branch, and wherein said switch is arranged in said primary electrical branch in series to said solid state breaker of said primary electrical branch.

15. The current breaker of claim 14, wherein each of said drives of the switch includes an electrical drive coil and a movable member, wherein said movable member is movable between a first and a second location and is connected to said first or second set of contact elements, respectively, wherein each drive is configured to accelerate said movable member from said first location away from said drive coil into said second location when a current flows through said drive coil.

16. The current breaker of claim 15, wherein the switch comprises a current pulse generator adapted to generate concurrent current pulses to the drive coil of said first drive and to the drive coil of said second drive.

17. The current breaker of claim 15 wherein in the switch the drive coil of said first drive and the drive coil of said second drive are electrically arranged in series.

18. The current breaker of claim 15, wherein in the switch each movable member is arranged in a bistable suspension, with said first and second location forming stable states of said bistable suspension.

19. The current breaker of claim 18, wherein in the switch each drive includes a first drive coil for moving said movable member from said first to said second location and a second drive coil for moving said movable member from said second to said first location.

20. The current breaker of claim 14, wherein the switch includes a housing.

21. The switch of claim 1, wherein the first and second drives are configured to move simultaneously and in opposite directions to double a relative contact separation speed of the switch.

22. The switch of claim 1, wherein the first and second drives configured to move simultaneously and in opposite directions to double a total contact separation distance of the switch.

* * * * *